United States Patent [19]

Dolan

[11] 4,029,239

[45] June 14, 1977

[54] CLOTHES HANGER

[76] Inventor: John E. Dolan, Old Orchard St., Harrison, N.Y. 10528

[22] Filed: Jan. 26, 1976

[21] Appl. No.: 652,231

[52] U.S. Cl. ..... 223/85; 223/92

[51] Int. Cl.[2] ..... A47J 51/097

[58] Field of Search ..... 223/85, 88, 92; 211/113; D6/247, 253, 255, 256

[56] References Cited

UNITED STATES PATENTS

| | | | |
|---|---|---|---|
| 1,321,997 | 11/1919 | Duberstein | 223/92 |
| 3,289,901 | 12/1966 | Zwanzig | 223/88 |
| 3,425,604 | 2/1969 | Mauldin | 223/88 |
| D124,556 | 1/1941 | Rhodes | D6/254 |

FOREIGN PATENTS OR APPLICATIONS

| | | | |
|---|---|---|---|
| 451,153 | 9/1948 | Canada | 223/92 |
| 181,525 | 11/1962 | Sweden | 223/85 |

*Primary Examiner*—George H. Krizmanich
*Attorney, Agent, or Firm*—John F. Ohlandt

[57] ABSTRACT

A plastic clothes hanger comprising an elongated, completely enclosed, hollow plastic body having extending arms.

3 Claims, 3 Drawing Figures

FIG. 1
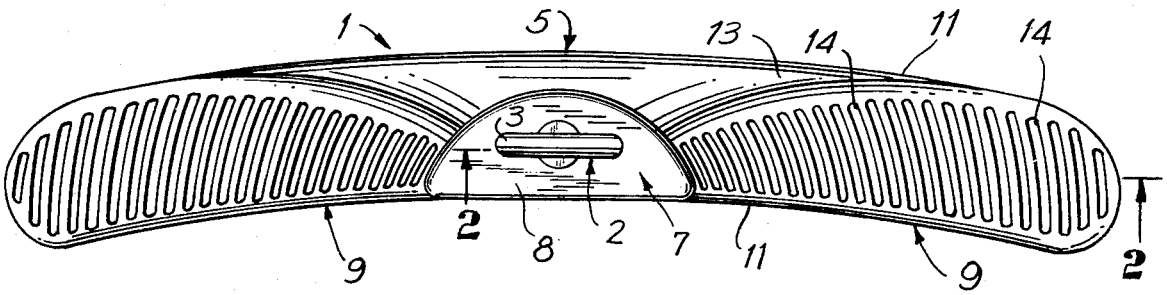
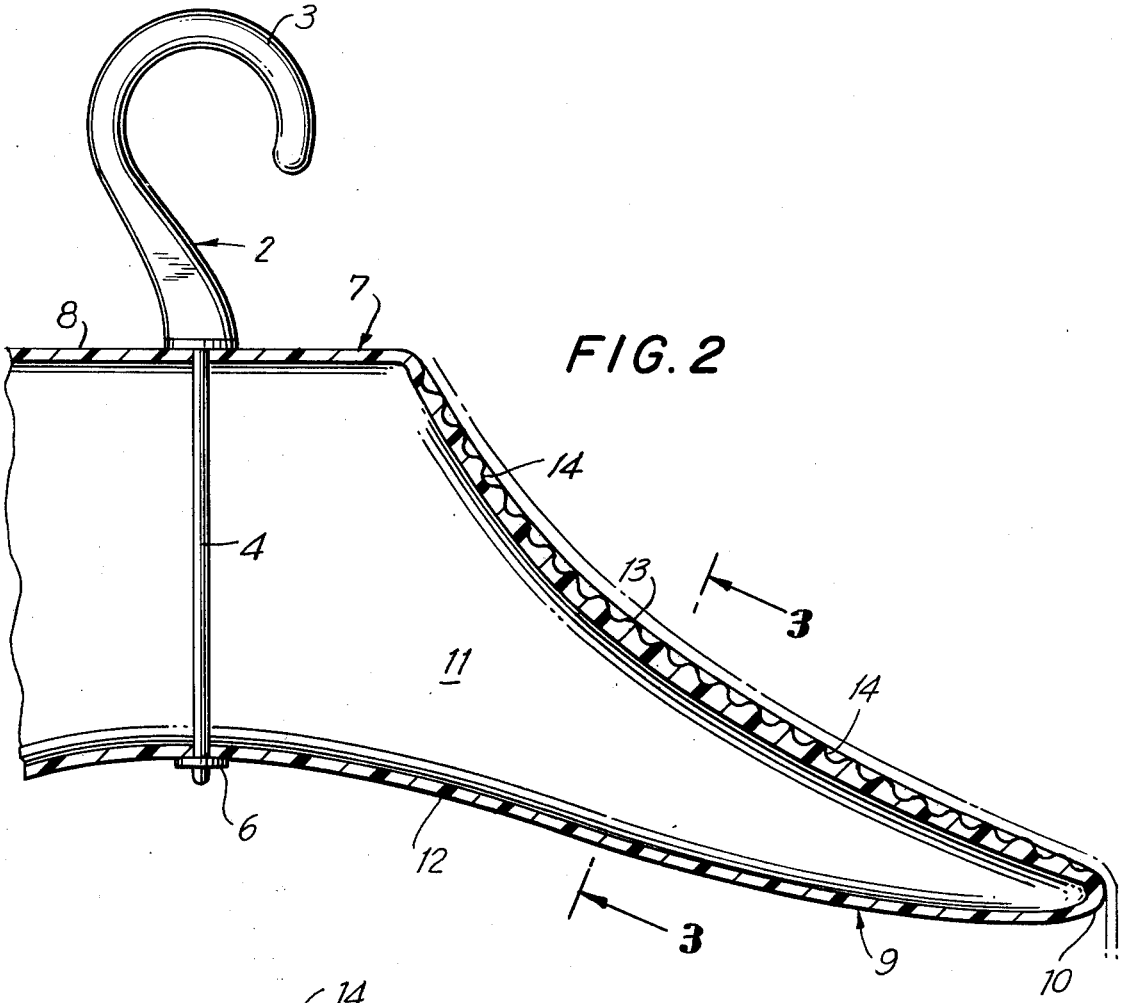
FIG. 2
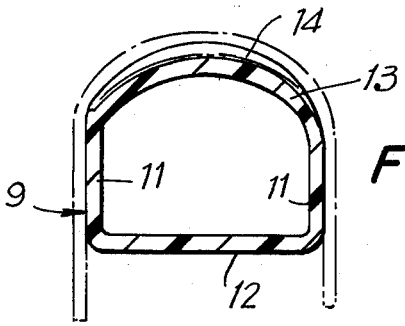
FIG. 3

CLOTHES HANGER

BACKGROUND, OBJECTS AND SUMMARY OF THE INVENTION

The present invention relates to clothes hangers, and more particularly, to improvements in a light-weight clothes hanger especially adapted for use with wet clothing.

A variety of devices have been known in the art for the purpose of hanging clothing: for example, the well-known standard wooden clothes hanger which is usually provided with a varnish coating or the like. Such a hanger is vulnerable to moisture and to wear whereby the varnish is easily removed and therefore the hanger is especially unsuitable for use with wet clothing.

It is often desirable, and particularly is it the case with wet clothing, that greater than usual spacing be provided between the front and back of the hanger so that the front of the garment may be prevented from touching the back, whereby much greater circulation of air will be promoted and hence more rapid drying of the garment will be achieved. The obvious disadvantage of the aforesaid wooden hanger in this respect is that, in order to achieve the foregoing objective, it has to be made quite thick or made in such a formidable shape or contour that it becomes a very expensive proposition.

It has been known, of course, to form a clothes hanger or the like of synthetic plastic material. As background for the present invention, reference can be made to U.S. Pat. No. 3,581,959 in which there is disclosed a plastic clothes hanger. Reference may also be made to Italian Pat. No. 523,183 in which a plastic clothes hanger made of several separable parts is described.

Another problem which presents itself in prior art designs is that the upper surface of the clothes hanger is not appropriately configured so as to promote the elimination of dust which tends to accumulate on the shoulder of a garment left on the hanger for long periods of time.

Accordingly, it is a primary object of the present invention to overcome the disadvantages of conventional clothes hangers and to provide a clothes hanger which has a variety of advantages over those of the prior art.

Another object is to provide a light-weight clothes hanger which will not be subject to mold and mildew.

Another object is to provide a clothes hanger which can be produced at very low cost by reason of lending itself to production in a blow mold process (needle blown process).

Another object of the invention is to provide a full shape or form, that is, to provide wide separation between front and back of the hanger so that great spacing will be afforded between the front and back of the garment when it is hung on the hanger. All of the aforesaid are to be accomplished while retaining the light-weight characteristics.

The above and other objects are fulfilled by the several features herein disclosed, the primary of which is the provision of a clothes hanger comprising an elongated, fully enclosed, hollow light-weight plastic body. By reason of the fact that it is a fully enclosed body, it possesses extremely great strength characteristics so that it can be subjected to rough treatment. It should also be noted that due to its formation of a light-weight plastic such as polyethylene, it is insured that it will retain its shape and will be inert to a variety of corrosion influences such as mold and mildew, etc.

The plastic hollow body for the clothes hanger of the present invention may be considered to comprise a central truncated conical section through which a hook may be extended as will be described. From the central section two symmetrical hollow arms diverge downwardly and these arms deviate, or curve away, from what may be termed a normal vertical plane. The vertical plane referred to is that defined when the hanger is appropriately hung on a suitable clothes rod or the like. The curvilinear shape for the arms means that clothing supported on the hanger, whether it be in the dry or wet state, will keep its shape better because such shape puts slight tension on the hung garment to eliminate wrinkles in its back.

In a typical construction the arms have a width of approximately two inches, thereby providing the requisite spacing required as noted previously.

Another feature is that the upper surfaces of the extending arms are fully rounded, that is, they are convexly shaped upwardly so that when the garment is hung, dust lines on the shoulder of the garment are eliminated, even though the garment may be hung for considerable periods of time. In other words, the very nature of the upper surfaces prevents dust accumulation.

It should also be noted that the back wall of the central section of the hanger merges with the rearward surfaces of the extending arms and is integral therewith. Also, the lower surfaces of the arms are inclined upwardly toward the central vertical axis of the hanger.

Other and further objects, advantages and features of the present invention will be understood by reference to the following specification in conjunction with the annexed drawing, wherein like parts have been given like numbers.

BRIEF DESCRIPTION OF THE DRAWING

FIG. 1 is a top plan view of a clothes hanger in accordance with a preferred embodiment of the present invention;

FIG. 2 is a fragmentary, vertical sectional view taken on the line 2—2 in FIG. 1; and FIG. 3 is a vertical sectional view taken on the line 3—3 in FIG. 2.

DESCRIPTION OF PREFERRED EMBODIMENT

Referring now to the figures, and for the moment to FIG. 1, there is illustrated a clothes hanger 1 adapted to be suspended by a hook 2, the hook being formed separately and having an appropriately curved upper part 3 so as to engage a clothes rod or the like and having a thin shank 4. The hook 2 extends along the central axis of a hollow body 5 defining the clothes hanger and is affixed or attached by a press-fitted nut 6.

The body 5, which is constituted of a plastic material such as polyethylene, is formed by a technique known as blow molding or by a technique known as needle blowing. In accordance with the former technique, plastic resin is extruded into a molten tube (called a parison), and the two halves of the mold close on the tube pinching the tube at the top and bottom. Air is blown into the tube which forms the plastic against the sides of the mold. There is chilled water running through the molds which cools the plastic. Then the mold is opened and the finished object, such as a hanger, is knocked out and the cycle starts all over again.

The technique of needle blowing involves the same process already described, but the method of introducing the air is different. On a container or like object, a blow pin is used because there is a large opening in the top of a container anyway. However, with a hanger or like object, a sharp needle is used which leaves a tiny hole.

The body 5 constitutes a completely enclosed structure and has what may be termed a central truncated conical section 7 inasmuch as it is provided with a flat upper surface 8. A pair of arms 9 diverge downwardly from the central section, terminating in rounded tips 10. Each arm also comprises front and rear side walls 11 which merge and are integral with the respective front and rear walls of the central section 7. Likewise, the lower or bottom walls of the arms 9 extend inwardly and upwardly and merge with the central section to define a web 12.

It should be especially noted that the upper surfaces 13 of the arms 9 are convexly curved, that is, they are convex upwardly, when one considers the normal orientation of the hanger. This insures that when dry garments are hanging on the hanger, the convexly rounded surfaces eliminate a problem which often occurs, namely, that dust lines are created on the shoulders of garments left for long periods of time.

Also, considering the normal orientation of the hanger, the curve of the front and rear walls 11 from the vertical plane is advantageous because it puts slight tension on the hung garment so as to eliminate wrinkles in the back thereof.

In the circumstance that clothes that have just been washed are placed on the hanger 1, their drying will be promoted because of the serrations or grooves 14 which extend from front to rear in the convex surfaces 13 of the arms 9. Such grooves allow water to run out of the shoulders of the garment for even drying. This is particularly important in the case of a shirt, in order that the shoulders of the shirt will dry quickly and evenly resulting in less wrinkles. Also, as previously noted, the thickness of the formed or molded body of the hanger insures that the front of the garment will be prevented from touching the back, thereby insuring less wrinkling. In addition, when garments are stored, the aforesaid grooves 14 permit moth-killing vapors to circulate freely through the shoulder area.

The described preferred embodiment of the improved clothes hanger of the present invention affords a great reduction in the likelihood of damage to the hanger because of the strength of the structure of the completely enclosed plastic body 5. Hence, great structural rigidty and stability are afforded by the present invention and moreover, because of the process of blow molding or the like which is applied, the clothes hanger of the invention can be produced in a variety of decorator colors, that is to say, color can be introduced very simply into the molding technique or process.

It will be understood and appreciated that each of the features aforedescribed may also find useful application in other combinations within a clothes hanger similar to that already described.

While there has been shown and described what is considered at present to be the preferred embodiment of the present invention, it will be appreciated by those skilled in the art that modifications of such embodiment may be made. It is therefore desired that the invention not be limited to this embodiment, and it is intended to cover in the appended claims all such modifications as fall within the true spirit and scope of the invention.

What is claimed is:

1. A clothes drying hanger comprising a unitary completely enclosed, hollow plastic body having a central truncated conical section and a pair of downwardly diverging arms, said body including substantially spaced front and back walls curving from a normal vertical plane, the upper surfaces of each of said arms being upwardly convex in the transverse direction;

the lower web or bottom wall of said enclosed, hollow plastic body extending from each end in an upward inclination toward the central vertical axis thereof;

a series of transverse, closely spaced, grooves in a substantially continuous, sinuous cross-sectional configuration along the length of said arms, said grooves being inclined along the length of said arms and being integrally formed to follow the transverse convex contour of said upper surfaces and to be defined by ridges flush with said upper surfaces.

2. A clothes hanger as defined in claim 1, in which said central truncated conical section extends vertically from its upper surface to said lower web for a distance approximately two-thirds of the full vertical dimension of said hollow plastic body.

3. A clothes hanger as defined in claim 1, including a hook member extending through suitable apertures in the upper surface of the conical section and through the lower web member so that a hook can be secured to said hollow plastic body.

* * * * *